US007412987B2

(12) United States Patent
Kemper et al.

(10) Patent No.: US 7,412,987 B2
(45) Date of Patent: Aug. 19, 2008

(54) EXPANSION TANK WITH VALVE

(75) Inventors: Dimitri Wasil Kemper, Amsterdam (NL); Jan Postma, Hendrik Ido Ambacht (NL); Jan Henk Cnossen, Koudum (NL)

(73) Assignee: Flamco B.V. (NL)

( * ) Notice: Subject to any disclaimer, the term of this patent is extended or adjusted under 35 U.S.C. 154(b) by 341 days.

(21) Appl. No.: 10/806,756

(22) Filed: Mar. 22, 2004

(65) Prior Publication Data

US 2004/0182945 A1 Sep. 23, 2004

(30) Foreign Application Priority Data

Mar. 20, 2003 (NL) ..... 1022985

(51) Int. Cl.
*F16T 1/20* (2006.01)

(52) U.S. Cl. ..... 137/192; 137/433; 137/601.2; 138/30

(58) Field of Classification Search ..... 137/192, 137/433, 601.2; 138/30
See application file for complete search history.

(56) References Cited

U.S. PATENT DOCUMENTS

| | | | | |
|---|---|---|---|---|
| 2,979,070 A * | 4/1961 | Payne | 137/192 |
| 3,082,793 A * | 3/1963 | Sugimura | 138/30 |
| 3,148,702 A * | 9/1964 | Mercier | 137/599.18 |
| 3,301,275 A | 1/1967 | Brady | 138/31 |
| 4,164,242 A * | 8/1979 | Sandau | 138/30 |
| 4,386,627 A * | 6/1983 | Lachaux | 138/30 |
| 4,742,842 A | 5/1988 | Garneau et al. | 137/172 |
| 6,682,316 B1 * | 1/2004 | Boke | 417/307 |

FOREIGN PATENT DOCUMENTS

| | | |
|---|---|---|
| CH | 397190 | 8/1965 |
| FR | 1390095 | 5/1988 |
| WO | WO 01/07356 * | 2/2001 |

OTHER PUBLICATIONS

The Netherlands Search Report.

* cited by examiner

*Primary Examiner*—John Rivell
*Assistant Examiner*—Craig M Schneider
(74) *Attorney, Agent, or Firm*—Ostrolenk, Faber, Gerb & Soffen, LLP

(57) ABSTRACT

An expansion tank to be connected to a pipe system filled or with a liquid is disclosed. The expansion tank includes at least one connection opening for a liquid pipe. The tank has a main valve to close off the connection opening at a defined difference in pressure between the interior of the tank and the connection opening and/or at a defined liquid level in the tank. The tank also has an additional valve for closing off a channel extending through the closure member of the main valve from the interior of the tank to the connection opening. The additional valve is closed during normal operation of the expansion tank and is open if the difference in pressure between the interior of the tank and the connection opening is higher than the original pressure in the expansion tank.

3 Claims, 8 Drawing Sheets

EXPANSION TANK WITH VALVE

BACKGROUND OF THE INVENTION

The invention relates to an expansion tank which is intended to be connected to a pipe system which is filled or is to be filled with a liquid, comprising a closed tank with at least one connection opening for a liquid pipe, the tank being provided with a main valve inside the tank, the main valve having a valve seat and a closure member which interacts with the valve seat and being designed to close off the connection opening at a defined difference between the pressure in the interior of the tank and the pressure in the connection opening and/or at a defined liquid level in the tank.

An expansion tank of this type known from, for example, CH-A-397190 and U.S. Pat. No. 3,301,275.

In the known expansion tanks the closure member of the main valve is a float body or connected to a float body. A drawback of the known expansion tanks is that in a situation wherein there is a high-speed liquid flow out of the expansion tank to the pipe system the closure member may dragged along with the liquid flow resulting in a closure of the main valve and a further drop of the pressure in the pipe system. When this happens the difference between the pressure in the interior of the expansion tank and the pressure in the connection opening may become higher than the pressure in the expansion when it was delivered ex works. This is undesirable, in particular when there is still a considerable amount of liquid in the expansion tank at the moment the main valve is closed. In that case it is difficult to bring the pipe system with expansion tank back into the normal operating conditions.

A difference between the pressure in the interior of the expansion tank and the pressure in the connection opening which is higher than the pressure in the expansion tank when it was delivered may also arise if so much gas has been released out of the pipe system into the tank that there is an excessive quantity of gas in the tank.

It is an object of the invention to provide an expansion tank of the above type which does not have the above mentioned drawbacks.

SUMMARY OF THE INVENTION

This object is achieved by an expansion tank which is intended to be connected to a pipe system which is filled or is to be filled with a liquid, comprising a closed tank with at least one connection opening for a liquid pipe, the tank being provided with a main valve inside the tank, the main valve having a valve seat and a closure member which interacts with the valve seat and being designed to close off the connection opening at a defined difference between the pressure in the interior of the tank and the pressure in the connection opening and/or at a defined liquid level in the tank, the tank being further provided with an additional valve in a channel extending through the closure member of the main valve from the interior of the tank to the connection opening, which additional valve is closed during normal operation of the expansion tank when connected to a pipe system filled with liquid and opens if the difference between the pressure in the interior of the tank and the pressure in the connection opening is higher than the original pressure in the expansion tank when it was delivered ex works.

With such an additional valve the difference between the pressure in the interior of the expansion tank and the pressure in the connection opening will drop to a level which is substantially equal to the pressure in the expansion tank when the tank was delivered ex works.

Preferred embodiments of the expansion tank according to the invention are defined in the subclaims.

BRIEF DESCRIPTION OF THE DRAWINGS

The invention will be explained in more detail in the following description with reference to the drawing, in which.

DETAILED DESCRIPTION OF THE INVENTION

Figure 1:
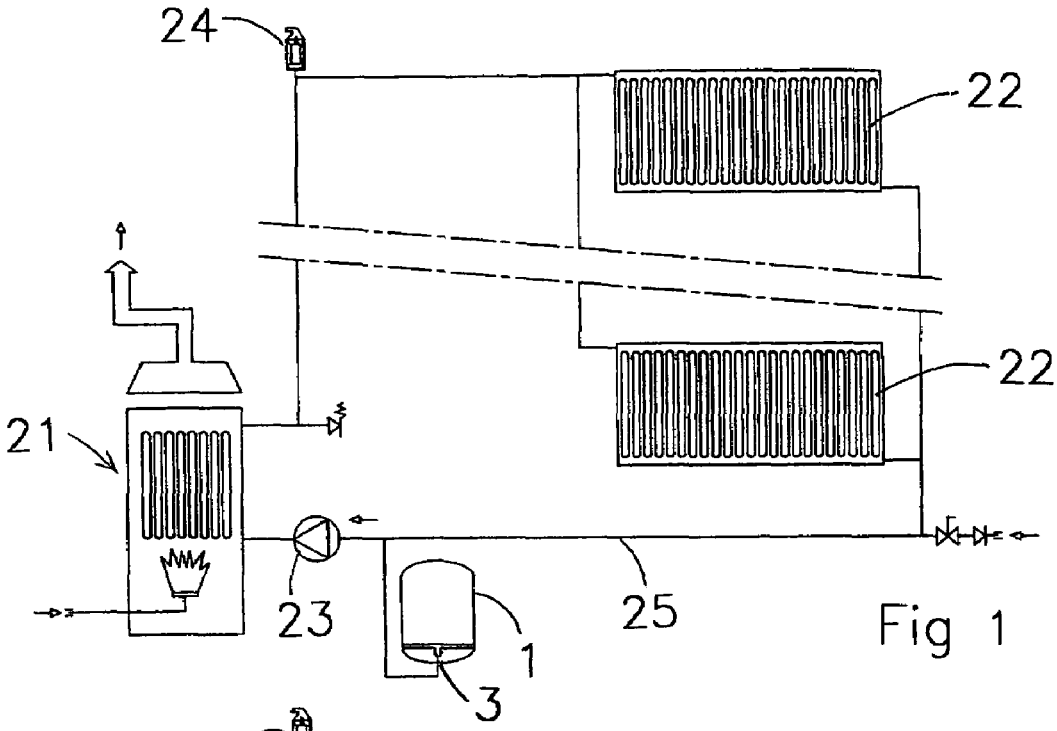
FIGS. 1 and 2 diagrammatically depict a heating installation in which an expansion tank according to the invention is incorporated, the expansion tank being positioned beneath (FIG. 1) and above (FIG. 2) a liquid pipe.
Figure 2:
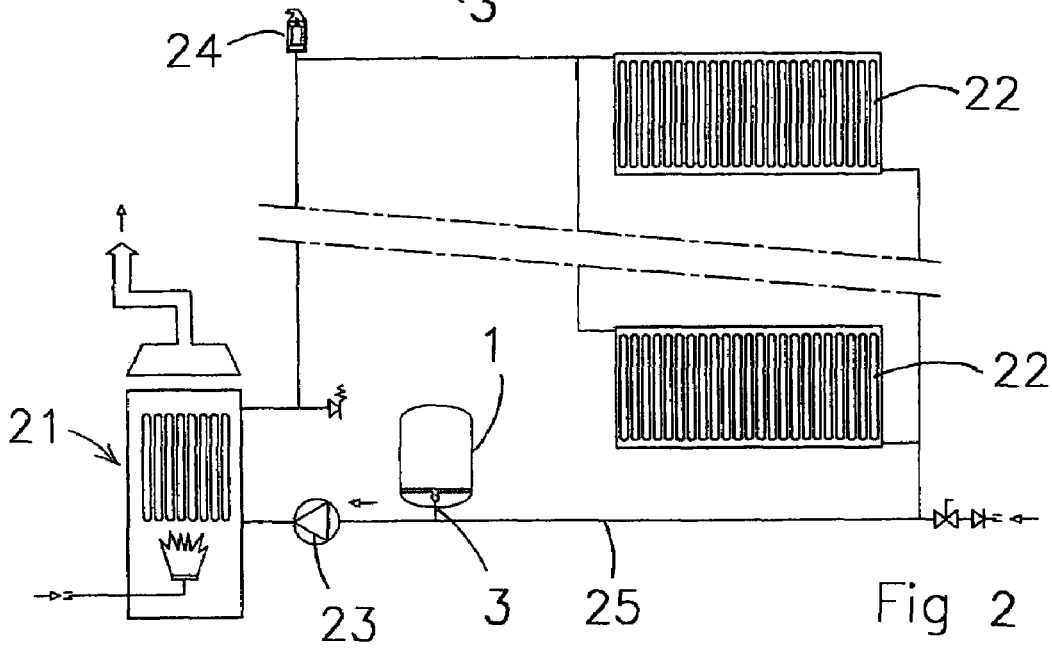

FIGS. 1 and 2 diagrammatically depict a heating installation in which an expansion tank 1 according to the invention is incorporated. The heating installation also comprises, as is customary, a heating boiler 21, radiators 22, a pump 23, a bleed 24 and connecting pipes between the various elements.

In FIG. 1, the expansion tank 1 is positioned below a liquid pipe 25 to which the tank 1 is connected. To prevent gas from undesirably flowing out of the expansion tank 1 into the installation and to prevent excess gases from the installation entering the expansion tank 1, the expansion tank 1 should be disposed in such a manner that the connection opening 3 is situated at the underside of the expansion tank 1.

In FIG. 2, the expansion tank 1 is positioned above a liquid pipe 25 to which the expansion tank 1 is connected. When the expansion tank 1 is mounted in such a position, it is possible for gases to escape from the installation into the expansion tank 1. In practice, this will lead to a slight increase in the quantity of gas in the expansion tank 1. This has no adverse effect on operation.

Figure 3A:
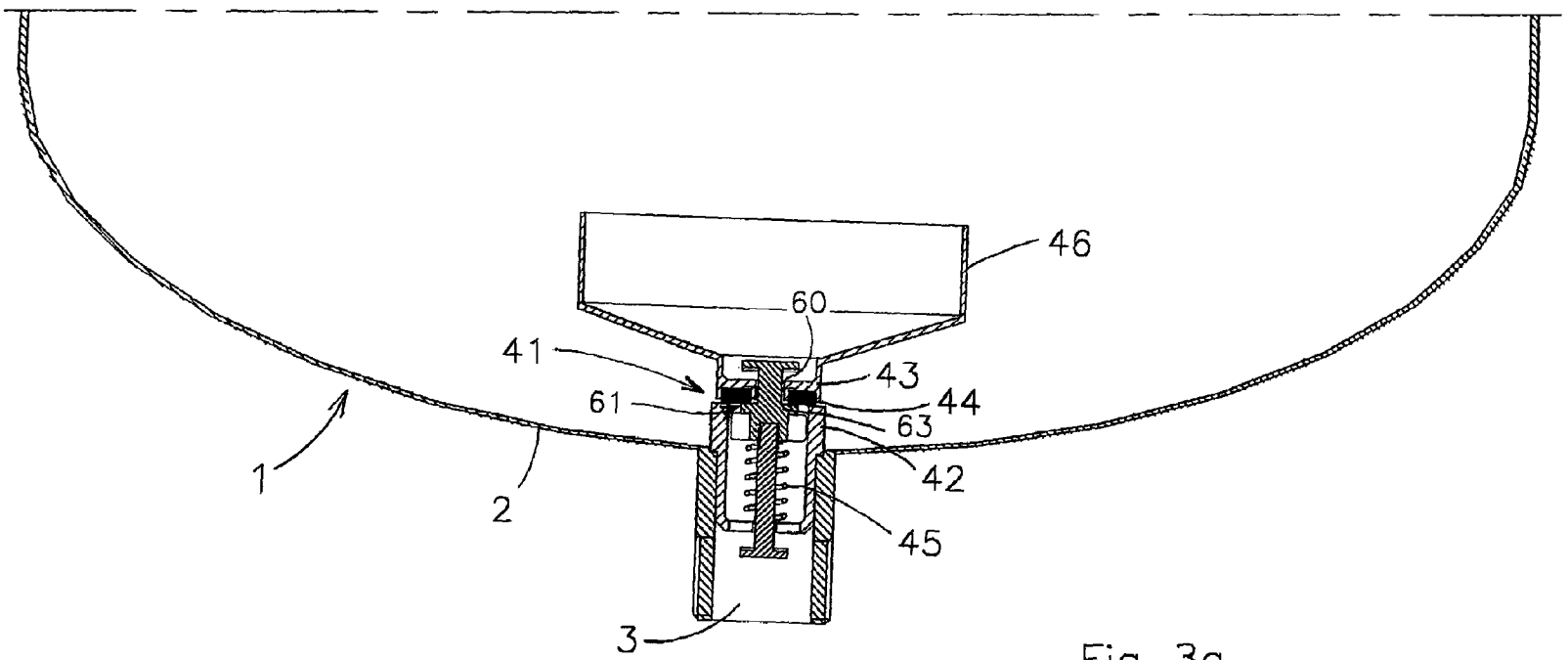
FIGS. 3*a-c* show a part of a first embodiment of an expansion tank according to the invention.
Figure 3C:
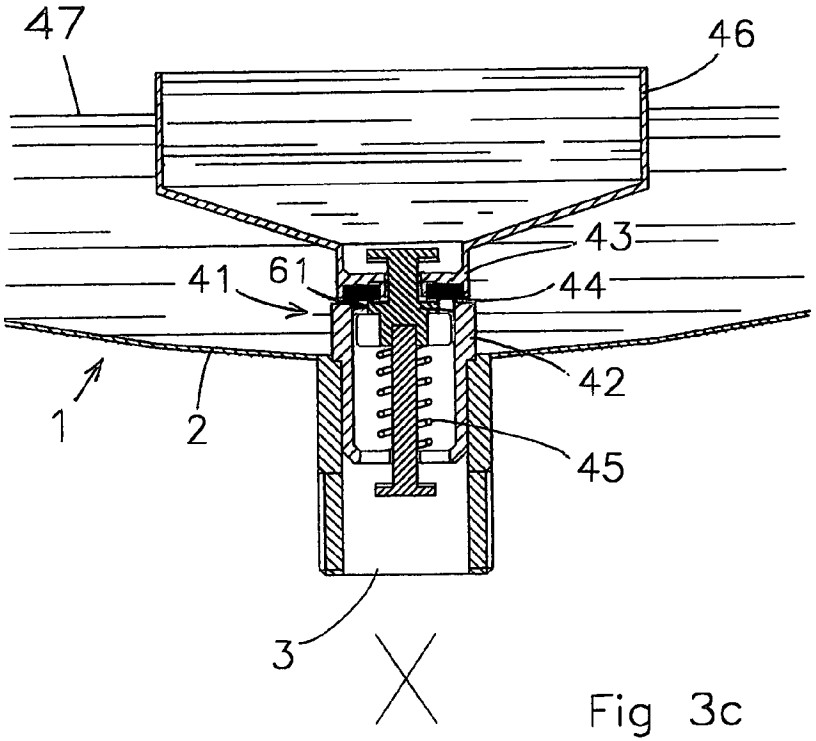
Figure 3B:
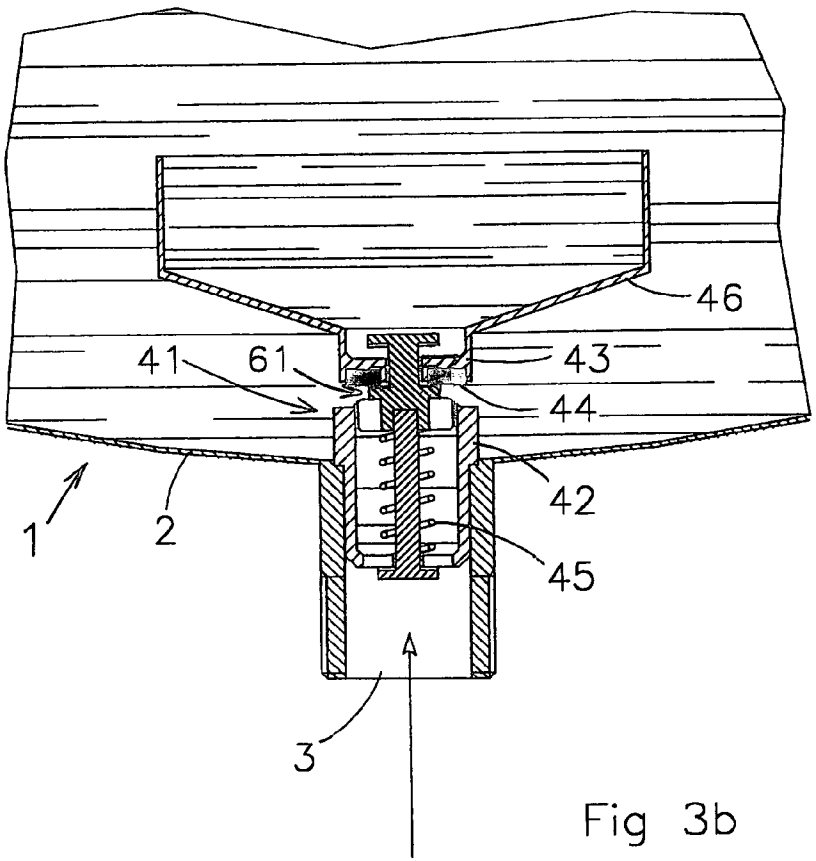

FIGS. 3*a-c* show a part of a first embodiment of an expansion tank 1 according to the invention. The expansion tank 1 is intended to be connected to a pipe system which is filled or is to be filled with a liquid, for example a heating system, as shown in FIGS. 1 and 2. The expansion tank 1 comprises a closed tank 2 with at least one connection opening 3 for a liquid pipe.

The expansion tank 1 is provided with a valve which is denoted overall by reference numeral 41. The valve 41 comprises a valve seat 42, which is connected to the connection opening 3 and a closure member 43. The valve seat 42 is of substantially cylindrical design. The closure member 43 is in disc form and is provided, on the side facing the valve seat 42, with a sealing ring 44 made from relatively soft material, such as rubber, which can interact with the end side of the valve seat 42 in order to close the valve 41. The closure member 43 is pressed away from the valve seat 44 by a compression spring 45. The closure member 43, for actuation of the valve 41, is provided, on the side facing towards the interior of the tank 2, with a cup-like element 46 which is fixed to the closure member 43 and is open towards the interior of the tank 2.

At the location of the closure member 43 in which there is a central passage 60, an additional valve 61 supplements the valve 41. By means of this additional valve 61 the interior of the tank 2 comes into communication with the connection opening 3 when the pressure difference between the interior of the tank 2 and the connection opening 3 becomes higher than the original pressure in the tank 2 when the expansion tank 1 was delivered ex works.

Such a high pressure difference may arise if so much gas has been released out of the pipe system into the tank 2 that there is an excessive quantity of gas in the tank 2, resulting in an excessively high gas pressure, which is higher than the original pressure in the tank 2 when the expansion tank 1 was delivered. The additional valve 61 provides for a discharge of the excess gas in the tank 2 to the connection opening 3.

A pressure difference between the interior of the tank 2 and the connection opening 3 which is higher than the original pressure in the tank 2 when the expansion tank 1 was delivered may also arise if the speed of liquid flowing out of the tank 2 into the pipe system is so high that the closure member 43 is dragged along with the liquid flowing out of the tank 2 resulting in a closure of the valve is closed and a further drop of the pressure in the pipe system.

Under normal operating conditions the additional valve 61 is closed by virtue of the fact that the spring 45 presses the closure member 63 of the valve 61 onto the sealing ring 44 and in this way closes off the passage 60. The spring 45 is dimensioned in such a manner that on the one hand it holds the valve 41 open when the pressure in the tank 2 and in the connection opening 3 is equal and on the other hand the valve 61 is opened by pressure in the tank 2 in the event that the pressure difference between the interior of the tank 2 and the connection opening 3 becomes higher than the original pressure in the tank 2 when the expansion tank 1 was delivered ex works.

Normal operation of the valve 41 is illustrated in FIGS. 3*a-c*.

FIG. 3*a* shows the position of the valve 41 when the expansion tank 1 is delivered ex works. The tank 2 is then full of pressurised gas. The pressure of the gas presses the closure member 43 onto the valve seat 42, counter to the spring force of the spring 45, so that the valve 41 is closed. The additional valve 61 is also closed.

FIG. 3*b* shows the situation in which the expansion tank 1 is connected to a liquid-filled pipe system. The pressure in this pipe system is equal to the pressure in the tank 2, which is higher than the pressure of the gas in the tank 2 when the expansion tank 1 was delivered. The spring 45 ensures that the closure member 43 is pressed away from the valve seat 42, so that there is an open connection between the connection opening 3 (and therefore the pipe system) and the interior of the tank 2. Also in this situation the additional valve 61 is closed.

FIG. 3*c* shows how the valve 41 is closed as soon as the liquid level 47 has reached a minimum after a drop in the level. The weight of the liquid which has remained behind in the cup-like element 46 presses the closure member 43 onto the valve seat 42, counter to the spring force of the spring 45, and the valve is closed. The additional valve 61 is also closed.

When for one the reasons mentioned above (excessive quantity of gas in the tank 2 or liquid flowing out of the tank 2 at high speed) the valve 41 is closed and the pressure difference between the interior of the expansion tank 2 and the connection opening 3 is higher than the original pressure in the tank 2 when the expansion tank was delivered the additional valve 61 is opened, counter to the spring force of the spring 45, and water or gas can flow out of the tank 2 to the opening 3.

Figure 4A:
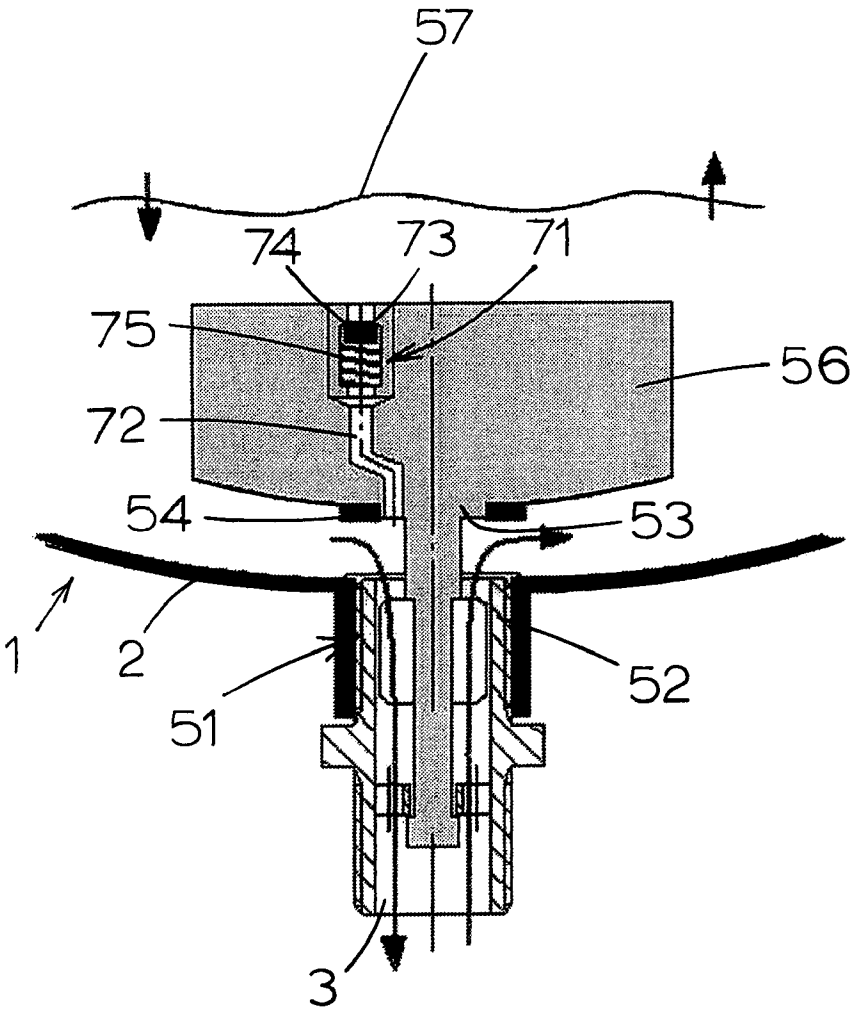
FIGS. 4*a-c* show a part of a second embodiment of an expansion tank according to the invention.
Figure 4C:
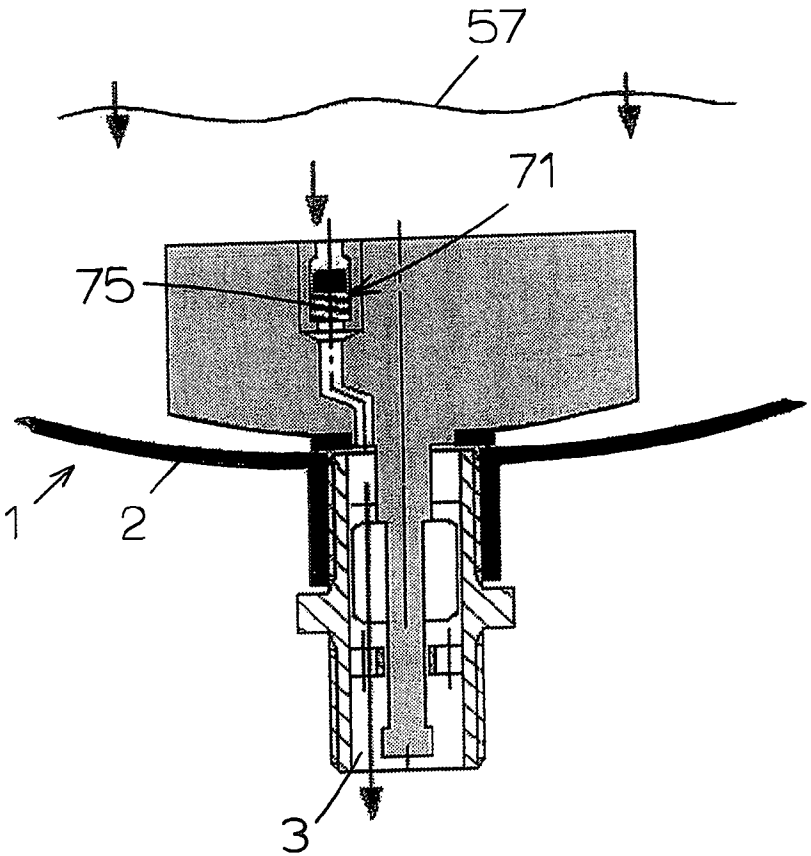
Figure 4B:
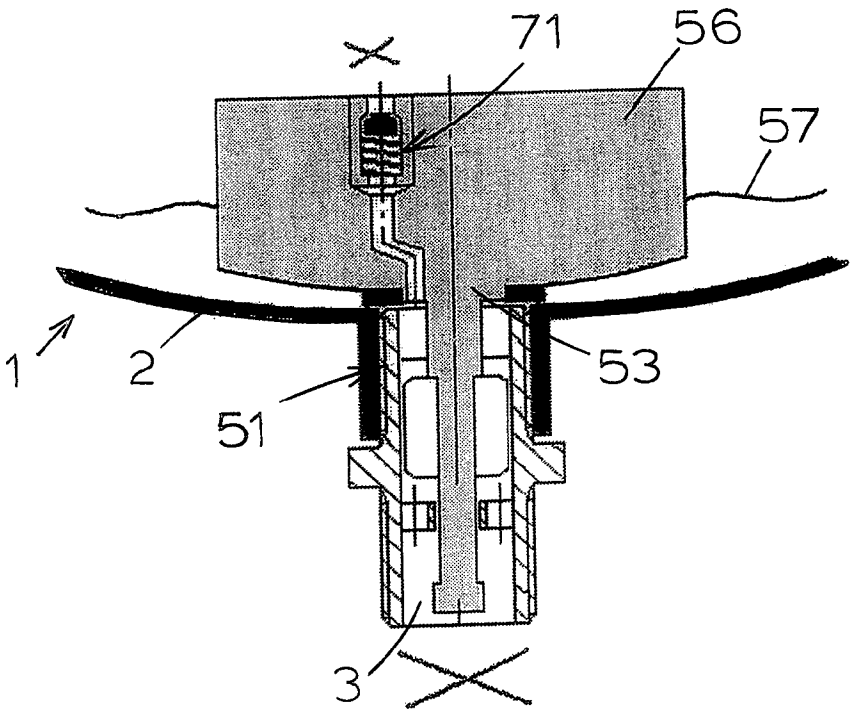

FIGS. 4*a-c* show a part of a second embodiment of an expansion tank according to the invention. In this embodiment the valve 51 is of a slightly different design as the valve 41 in the embodiment shown in FIGS. 3*a-c*. The valve has a valve seat 52, a closure member 53 and a sealing ring 54. Instead of the cup-like element 46 shown in FIGS. 3*a-c*, a body 56 is mounted on the closure member 53 of the valve 51. The closure member 53 is an integral part of a body 56. The weight of this body 56 is in itself sufficient to press the closure member 53 onto the valve seat, so that the valve 51 is closed. However, the density of the body 56 is slightly lower than the density of the liquid in the tank 2. Therefore, a spring to press the closure member 53 away from the valve seat 52 to keep the valve 51 open during normal operation of the expansion tank 1 is not necessary.

The expansion tank 1 has an additional valve. The additional valve is designed as a small valve 71 in a channel 72 in the body 56. The channel 72 extends from the top side of the body 56 to the region of the bottom side of the body 56 inside the sealing ring 54. The valve 71 has a valve seat 73, a closure member 74 and a spring 75 which presses the closure member 74 on the valve seat 73.

When the expansion tank 1 is delivered ex works the pressure of the gas in the tank 2 is sufficient to hold the valve 51 closed for the purpose of storage, transport and installation of the expansion tank.

The way in which the valve 51 operates in normal situations is illustrated in FIGS. 4*a-b* and substantially corresponds to the operation of the valve 41 illustrated in FIGS. 3*a-c*.

In FIGS. 4*a-c* the expansion tank 2 is connected to liquid-filled pipe system. When the pressure in the pipe system, which is equal to the pressure in the connection opening 3, is higher than the pressure in the tank 2 when the expansion tank 1 was delivered the tank 2 is filled with liquid, and there is an equilibrium between the pressure in the tank 2 and the pressure in the pipe system. Due to the upward force on the body 56 in the liquid the valve 51 is open and liquid can flow in and out of the expansion tank 2. The additional valve 71 is closed. This situation is shown in FIG. 4*a*.

FIG. 4*b* shows how the valve 51 closes when the body 56 on top of the closure member 53 of the valve 51 dries out as the liquid level 57 drops.

When for one the reasons mentioned above (excessive quantity of gas in the tank 2 or liquid flowing out of the tank 2 at high speed) the valve 51 is closed and the pressure difference between the interior of the tank 2 and the connection opening 3 is higher than the original pressure in the tank 2 when the expansion tank 1 was delivered the additional valve 71 is opened, counter to the spring force of the spring 75, and water or gas can flow out of the expansion 2 to the connection opening 3. This situation is shown in FIG. 4*c*.

FIGS. 5*a-d* show a part of a third embodiment of an expansion tank 1 with an additional valve.

In FIGS. 5*a-d* the valve 51 is similar to the valve 51 in FIGS. 4*a-c* and has a seat 52, a closure member 53 and a sealing ring 54. Instead of a body 56 the closure member 53 is provided with a cup-like element 86 like the cup-like element 46 on the closure member 43 in FIGS. 3*a-c*. A channel 87 which extends through the closure member 53 of the valve 51 connects the interior of the cup-like element 86 with the connection opening 3. The edge of the opening of the channel 87 to the interior of the cup-like element 86 is formed as a valve seat 88. A second float body 90 is arranged inside the cup-like element 86 and is freely moveable therein. At the bottom side the float body 90 is provided with a needle-shaped closure member 91 which can cooperate with the valve seat 88. The needle-shaped closure member 91 and the valve seat 88 form the additional valve. Retaining elements 92 at the free edge of the cup-like element 86 prevent the float body 90 from leaving the cup-like element 86.

The valve 51 in FIGS. 5*a-d* operates in the same way as the valve 51 in FIGS. 4*a-c*.

Figure 5B:
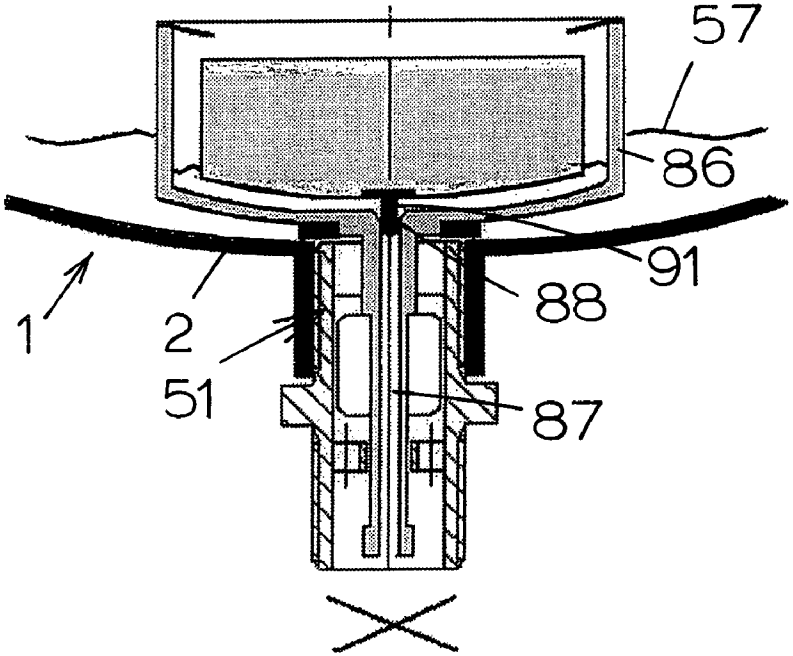
FIGS. 5*a-d* show a part of a third embodiment of an expansion tank according to the invention.
Figure 5A:
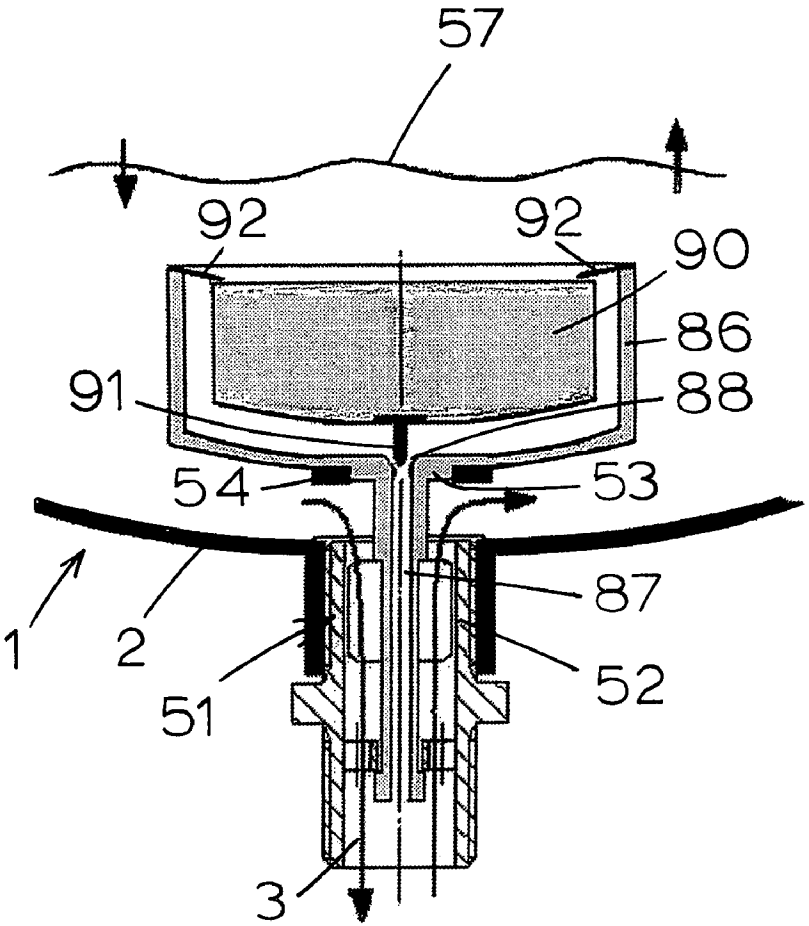

During normal operation of the expansion tank 2 the valve 51 is open and liquid can flow in and out of the expansion tank 2 (FIG. 5*a*). The needle valve 88,91 is also open. The float body 90 is retained in the cup-like element 86 by the retaining elements 92.

When the liquid level 57 in the tank 2 drops to a level as shown in FIG. 5*b* the valve 51 is closed. The needle valve 88,91 will close when most of the liquid has flown out of the cup-like element 86 through the channel 87 as shown in FIG. 5*b*.

Figure 5D:
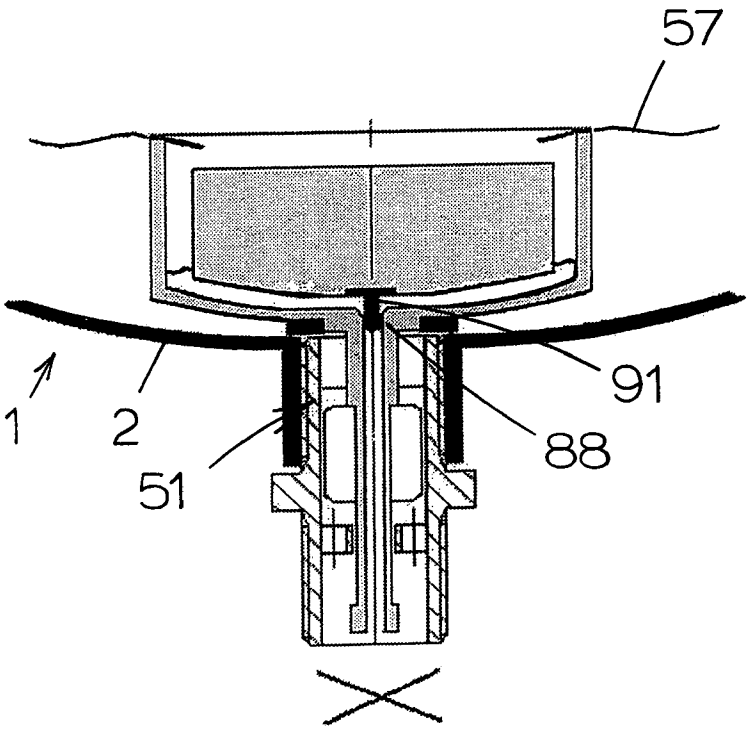
Figure 5C:
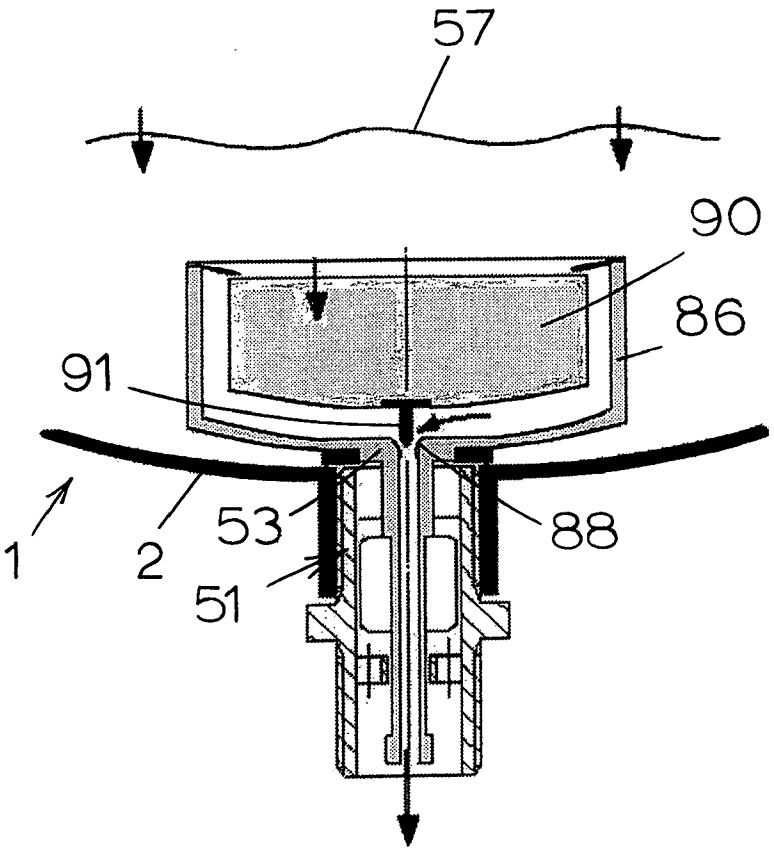

When the valve 51 is closed as a result of liquid flowing out of the tank 2 at high speed the needle valve 88,91 will still be open as long as there is enough liquid in the tank 2 and the cup-like body 56 (FIG. 5*c*). This is realised in that the floating capability of the float body 90 is always sufficient to keep the needle valve 88,91 open, counter to the higher pressure in the tank 2. In case of such a higher pressure in the tank 2 the valve 51 will be closed as the size of this valve is such the closing force on the closure member 54 as result of the higher pressure in the tank 2 is greater than the upward floating force on the combination of the cup-like element 86 and the float body 90.

When the liquid level in the tank 2 and in the cup-like element 86 drops to the level shown in FIG. 5*d* the valve 88,91 closes.

The advantage of the embodiment of the expansion tank 1 of FIG. 5 over the embodiments of FIGS. 3 and 4 is that in case the main valve 51 is closed as a result of liquid flowing out of the tank 2 at high speed, the additional valve 88,91 remains open and the pressure in the tank 2 will drop together with the pressure in the pipe system as long as there is enough liquid in the tank 2. In the embodiments of FIGS. 4 and 5 the additional valve 41, 51 will be opened only after the pressure difference between the interior of the tank 2 and the pipe system becomes higher than the pressure in the expansion tank 1 when it was delivered.

If in the situation shown in FIG. 5*d* the pressure in the tank 2 is still too high (higher than the pressure in the tank 2 when the expansion tank 1 was delivered), for example as a result of an excessive quantity of gas in the tank 2, this pressure cannot be decreased further as both valves 51 and 88,91 are closed. A solution for this problem is shown in FIGS. 6*a-b*.

Figure 6B:
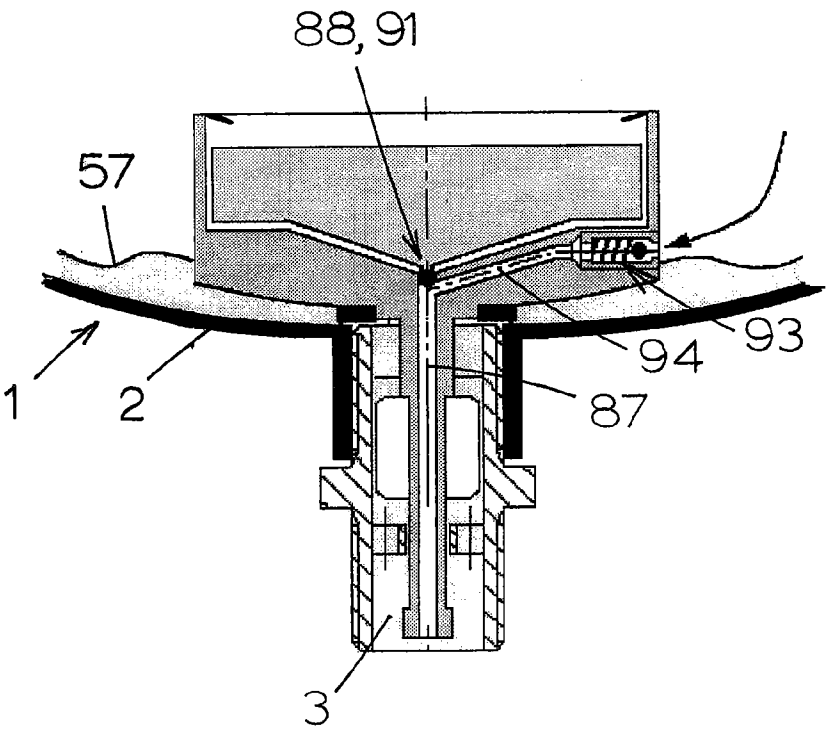
FIGS. 6*a-b* show a part of a fourth embodiment of an expansion tank according to the invention.
Figure 6A:
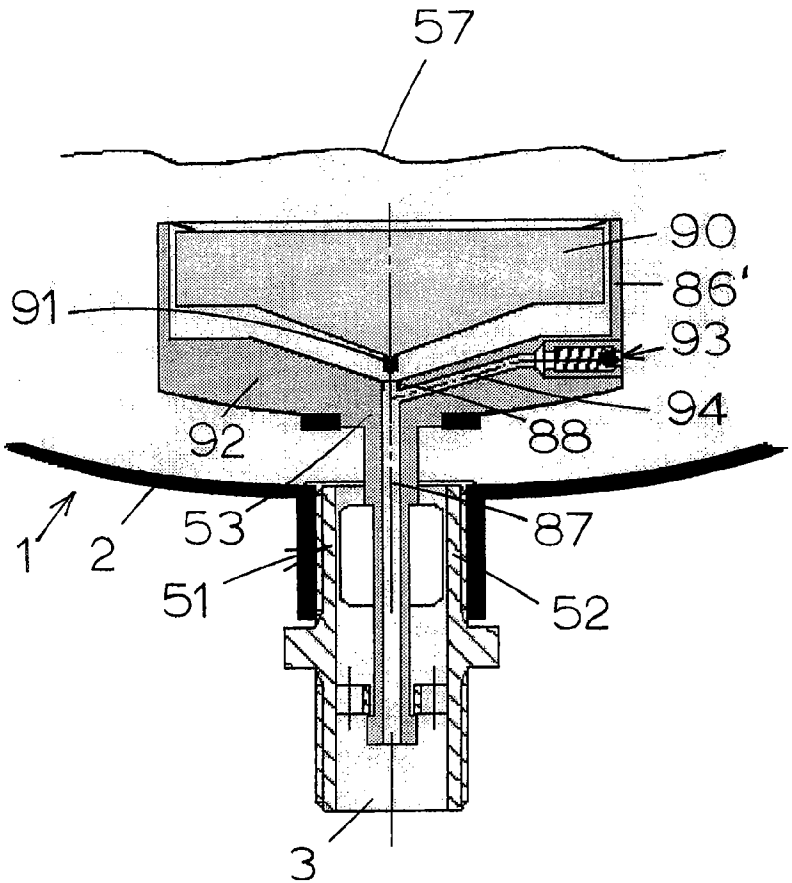

FIGS. 6*a-b* show a part of a fourth embodiment of an expansion tank 1 with two additional valves.

The embodiment of FIG. 6 is basically the same as the embodiment of FIG. 5 with the additional valve 88,91. However, the cup-like element 86' has a bottom 92 which is thicker than the bottom of the cup-like element 86 of the embodiment of FIG. 5. The cup-like element 86' is provided with a second additional valve 93. This second additional valve 93 is designed as a small valve in a channel 94 in the thick bottom 92 of the cup-like element 86'. The channel 94 extend from the outer side of the cup-like element 86' to the central channel 87 in the closure member. The second additional valve 93 is of the same type as the additional valve 71 in the embodiment of FIG. 4. The embodiment of FIG. 6 is essentially a combination of the embodiments of the embodiments of FIGS. 4 and 5.

If, in the situation wherein the both the valve 51 and the additional valve 88,91 are closed, the pressure in the tank is still too high the second additional valve 93 is opened and liquid and/or gas can be discharged through the second additional valve 93 and the channel 94 to the connection opening 3, as shown in FIG. 6*b*.

In FIGS. 3-6 the valve seat 42, 52 is of substantially cylindrical design, with the closure member 43, 53 interacting with the end side of the valve seat 42, 52. The valve seat may however be of conical or cup-like design. In this case, the closure member is provided on its circumference with a sealing ring, which can interact with the conical or cup-like inner surface of the valve seat.

It will be clear for a skilled person that within the scope of the claims the design of the various components of the expansion tank according to the invention may be varied.

The invention claimed is:

1. An expansion tank system operable to be connected to a pipe system, the expansion tank system comprising:

a tank configured to contain a liquid and/or a gas;

a connection opening configured to connect the tank to the pipe system;

a main channel positioned between the tank and the connection opening;

a main valve positioned in the main channel and configured to separate the inside of the tank from the connection opening, the main valve comprising a first valve seat and a first closure member interacting with the first valve seat and being operable:

a) to close off the main channel at a defined overpressure when the pressure inside the tank is greater than the pressure in the connection opening, said overpressure having a defined level, and b) to close off the main channel at a defined liquid level in the tank, said overpressure and/or liquid level in the tank closing off the main channel by pressing the first closure member against the first valve seat;

an auxiliary channel extending through the first closure member of the main valve from the interior of the tank to the connection opening when the main valve is in a closed position, wherein said expansion tank system is manufactured such that the tank has at least the defined overpressure ex works, the expansion tank system further comprising:

an additional valve positioned in the auxiliary channel formed to close off the auxiliary channel, the additional valve being formed to be closed during normal operation of the expansion tank when connected to the pipe system and to be opened when, during operation, a second overpressure exists in the tank greater than the overpressure which exists ex works.

2. The expansion tank according to claim 1 wherein the first closure member is provided, on the side facing the first valve seat, with a sealing ring made from soft material operable to interact with the first valve seat to close the main valve, the first closure element being formed by a part of the bottom wall of a body inside the expansion tank, and wherein the additional valve is a valve in a channel in the body, the channel extending from the top side of the body to the region of the first closure member inside the sealing ring, the additional valve comprising a valve seat, a closure member and a spring urging the closure member on the valve seat, the valve seat and the spring acting towards the interior of the expansion tank, the spring being dimensioned such that if a difference between the pressure in the interior of the expansion tank and the pressure in the connection opening reaches the second overpressure greater than the overpressure which exists ex works the closure member is pressed away from the seat, counter to the spring force of the spring, whereby the additional valve is opened.

3. The expansion tank of claim 2 wherein the sealing ring comprises rubber.

* * * * *